US006253772B1

(12) United States Patent
Chambers et al.

(10) Patent No.: US 6,253,772 B1
(45) Date of Patent: Jul. 3, 2001

(54) HAIR SCULPTING APPARATUS AND METHODS

(76) Inventors: Synneve Chambers, 5740 Martel, Apt. B4, Dallas, TX (US) 75206; Mark Walker Rhodes, 7502 Rosemont Rd., Dallas, TX (US) 75217

( * ) Notice: Subject to any disclaimer, the term of this patent is extended or adjusted under 35 U.S.C. 154(b) by 0 days.

(21) Appl. No.: 09/309,059

(22) Filed: May 10, 1999

(51) Int. Cl.[7] ..... A45D 8/04; A45D 8/12; A45D 8/22

(52) U.S. Cl. ..... 132/273; 132/275; 132/278

(58) Field of Search ..... 132/273, 275, 132/276, 277, 278; 63/3.1, 3.2, 41; 2/181.8, 181, 183, 323, 325

(56) References Cited

U.S. PATENT DOCUMENTS

| | | | | |
|---|---|---|---|---|
| D. 50,668 | * | 4/1917 | Steiner | 132/273 |
| 1,437,440 | * | 12/1922 | Pentecost | 132/273 |
| 4,788,991 | * | 12/1988 | Nocera et al. | 132/273 |
| 5,564,445 | * | 10/1996 | Query | 132/273 |
| 5,655,550 | * | 8/1997 | Keating | 132/273 |
| 5,946,728 | * | 9/1999 | Tane | 132/273 |
| 5,950,637 | * | 2/1999 | Chang | 132/273 |

FOREIGN PATENT DOCUMENTS

| | | | | |
|---|---|---|---|---|
| 481613 | * | 3/1952 | (CA) | 132/273 |
| 426322 | * | 4/1911 | (FR) | 132/273 |
| 1018155 | * | 1/1966 | (GB) | 132/273 |

* cited by examiner

*Primary Examiner*—John J. Wilson
*Assistant Examiner*—Robyn Kieu Doan
(74) *Attorney, Agent, or Firm*—Burleigh & Associates; Roger S. Burleigh

(57) ABSTRACT

A hair sculpting device having an elongated member with first and second free end portions and a middle portion. Universal coupling means are disposed proximate the first and second tree end portions and at least one intermediate location along the middle portion. The universal coupling means are adapted to allow the first and second free end portions and the intermediate location to be selectively coupled. The universal coupling means can be further used to couple the device to one or more additional devices, thereby allowing a user to configure the device(s) as a function of the hair length or form. In an exemplary embodiment, the universal coupling means includes a female portion having a closed loop and a male portion having adjacent first and second flexible prongs. Each of the first and second flexible prongs has an outwardly projecting shoulder portion adapted to retain the male portion in the female portion. In an alternate exemplary embodiment, the universal coupling means includes a male portion having an external wall and a female portion having an internal wall, and the external wall of the male portion has a profile substantially similar to the internal wall of the female portion. The male and female portion can take the form of a tapered cylinder and a C-shaped member having an internal wall defining a tapered cylinder, respectively; the male and female portions being adjacent and axially-aligned.

12 Claims, 3 Drawing Sheets

HAIR SCULPTING APPARATUS AND METHODS

TECHNICAL FIELD OF THE INVENTION

The present invention is directed, in general, to hair care accessories and, more specifically, to apparatus and methods for sculpting hair.

BACKGROUND

Various devices, such as combs, barrettes, clips, bows, and the like to shape, or "sculpt," hair have been known for thousand of years. Such devices are commonly available in a plethora of colors and designs, and are used for functional as well as aesthetic reasons. Although prior art hair devices are useful, such devices are generally designed to address only one or a few contemplated hair styles.

U.S. Pat. No. 5,564,445 discloses a hair braiding tool. The hair braiding tool includes an elongated body member comprising a continuous curving web and means to couple the ends of the device together to form a circle for use in sculpting a "Bun" or "Halo" hairstyle. Because the length of the hair braiding tool is fixed, except to the extent that it may be stretched, it may not be of a suitable length either for the person's head size, hair length, or desired hair style.

U.S. Pat. No. 5,318,054 discloses a spiral spring hair barrette assembly. The disclosed assembly, is said to be useful for holding ponytails and other decorative hair configurations. Because the assembly has a substantially fixed configuration, however, it also may not be of a size desirable for use with a particular hair length or desired hair style.

Other examples of the prior art include U.S. Pat. Nos. 2,547,295 ("Hair Retaining Device"), 5,379,782 ("Hair Fashion Accessory), 5,458,108 ("Hair Comb"), and 5,335,680 ("Hair Clip"). All of the aforementioned hair devices, however, are each limited to only one or a few configurations. If a specific device must be selected as a function of each specific user's head size, hair length, or desired hair style, it is thus necessary not only for manufacturers to produce a broad array of devices and sizes thereof, but it is also necessary for a user to purchase separate devices for each desired hair style.

Accordingly, there is a need in the art for a hair sculpting apparatus, and methods of use thereof, that is universally-adaptable to meet the requirements of many persons, regardless of a user's head size, hair length, or desired hair style.

BRIEF SUMMARY OF THE INVENTION

To address the above-described deficiencies of the prior art, novel hair sculpting apparatuses, and methods of use thereof, are disclosed herein. In particular, hair sculpting devices that are universally-adaptable to meet the requirements of many persons, regardless of a user's head size, hair length, or desired hair style, are disclosed; whereby a user can manipulate and couple the device into an infinite variety of configurations.

In one embodiment, the device has an elongated member having first and second free end portions and a middle portion. In an exemplary embodiment, the elongated member includes a plurality of serpentine portions forming interstitial regions in which locks of hair can be confined and retained. The elongated member can take any desired form, however, such as straight or curved. The device can also be designed to be substantially hidden within the hair of a user, or can include ornamental elements intended to extend without the user's hair. The device can also be flexible and extensible.

Universal coupling means are disposed proximate the first and second free end portions and an intermediate location along the middle portion of the elongated member. The universal coupling means are adapted to allow the first and second free end portions and the intermediate location to be selectively coupled. The universal coupling means can be further used to couple the device to one or more additional devices, thereby allowing a user to configure the device(s) as a function of the hair length or desired hair style.

In an exemplary embodiment, the universal coupling means includes a female portion having a closed loop and a male portion having adjacent first and second flexible prongs. Each of the first and second flexible prongs has an outwardly projecting shoulder portion adapted to retain the male portion in the female portion. The outwardly projecting shoulder portions also provide a means to anchor the device within a users hair.

In an alternate exemplary embodiment, the universal coupling means includes a male portion having an external wall and a female portion having an internal wall, and the external wall of the male portion has a profile substantially similar to the internal wall of the female portion. The male and female portion can take the form of a tapered cylinder and a C-shaped member having an internal wall defining a tapered cylinder, respectively. In an embodiment to be specifically shown and described, the male and female portions are adjacent and axially-aligned.

The universal coupling means can also be provided at a plurality of locations along the middle portion of the device. In such embodiments, the end portions of the device can be selectively coupled to any intermediate location of the device having a coupling means. Furthermore, one or more intermediate locations of the device can be selectively coupled to other intermediate locations of the same device, or to a second device.

In the embodiments illustrated, the universal coupling means are integrally-formed with the elongate member. Such embodiments can be suitably manufactured using plastic materials, which may be either rigid or flexible. Furthermore, the use of plastic materials provides the easy capability to mold the device in a variety of colors, including the molding of various portions of the same device from different colors.

The disclosed devices are infinitely configurable and adaptable to a broad range of desired hairstyles. One or more devices can be coupled into a desired configuration prior to insertion into a user's hair; alternatively, the devices can be selectively coupled after insertion.

The foregoing has outlined, rather broadly, the principles of the present invention so that those skilled in the art may better understand the detailed description of the exemplary embodiments that follow. Those skilled in the art should appreciate that they can readily use the disclosed conception and exemplary embodiments as a basis for designing or modifying other structures and methods for carrying out the same purposes of the present invention, and that such equivalent constructions do not depart from the spirit and scope of the invention in its broadest form, except as specifically limited by the claims recited hereinafter.

BRIEF DESCRIPTION OF THE DRAWINGS

For a more complete understanding of the present invention, reference is now made to the following detailed description taken in conjunction with the accompanying drawings, in which.

DETAILED DESCRIPTION OF THE INVENTION

Figure 1:
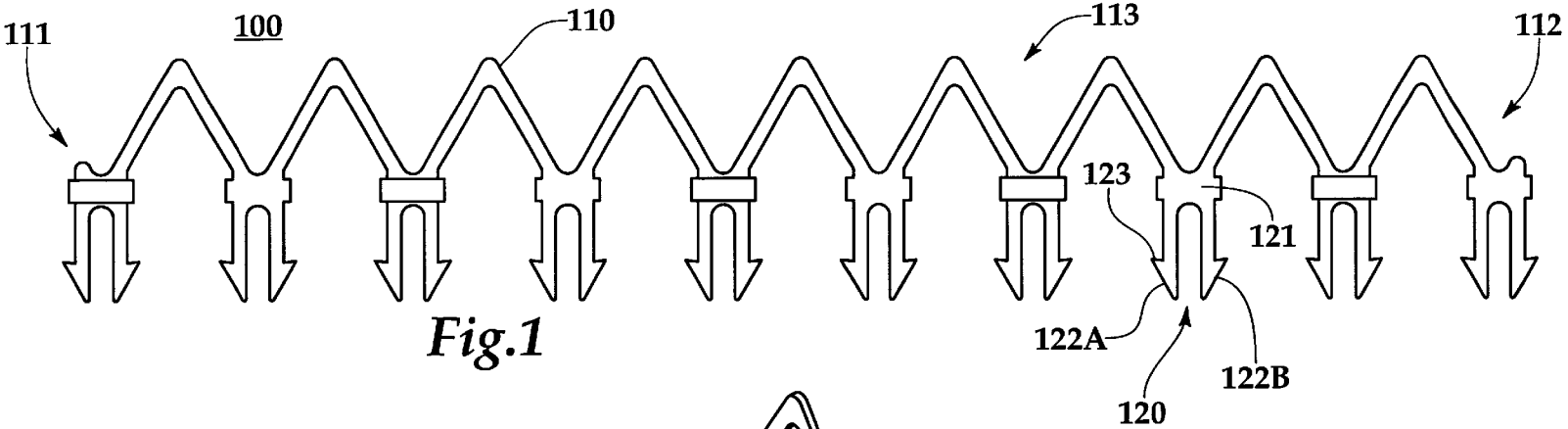
FIG. 1 illustrates a side view of a first exemplary hair sculpting device in accordance with the principles of the present invention.

Referring initially to FIG. 1, illustrated is a side view of a first exemplary hair sculpting device 100 in accordance with the principles of the present invention. The exemplary hair sculpting device 100 has an elongated member 110 having first and second free end portions, generally designated 111 and 112, respectively, and a middle portion, generally designated 113. The elongated member 110 includes a plurality of serpentine portions forming interstitial regions in which locks of hair can be confined and retained. In some embodiments, the elongated member 110 can be elastic, whereby the hair sculpting device 100 be extensible to a desired length or contractible to assist in confining and retaining locks of hair between the serpentine portions. Furthermore, although exemplary device 100 has a serpentine elongated member 110, the elongated member can take any desired form, such as straight or curved, or a combination of various forms. The hair sculpting device 100 can also be designed to be substantially hidden within the hair of a user, or can include ornamental elements (not shown) intended to extend without the users hair.

The hair sculpting device 100 further includes universal coupling means, generally designated 120, disposed proximate the first and second free end portions 111 and 112. Universal coupling means 120 are also provided at intermediate locations along the middle portion 113 of the elongated member 110. The universal coupling means 120 of hair sculpting device 100 include a female portion 121 having a closed loop (see FIG. 2) and a male portion 122 having adjacent first and second flexible prongs 122-A and 122-B. Each of the first and second flexible prongs 122-A and 122-B preferably include outwardly projecting shoulder portions, generally designated 123; the shoulder portions 123 are adapted to retain the male portion 122 in the female portion 121. The outwardly projecting shoulder portions 123 also provide a means to anchor the device within a user's hair.

Figure 2:
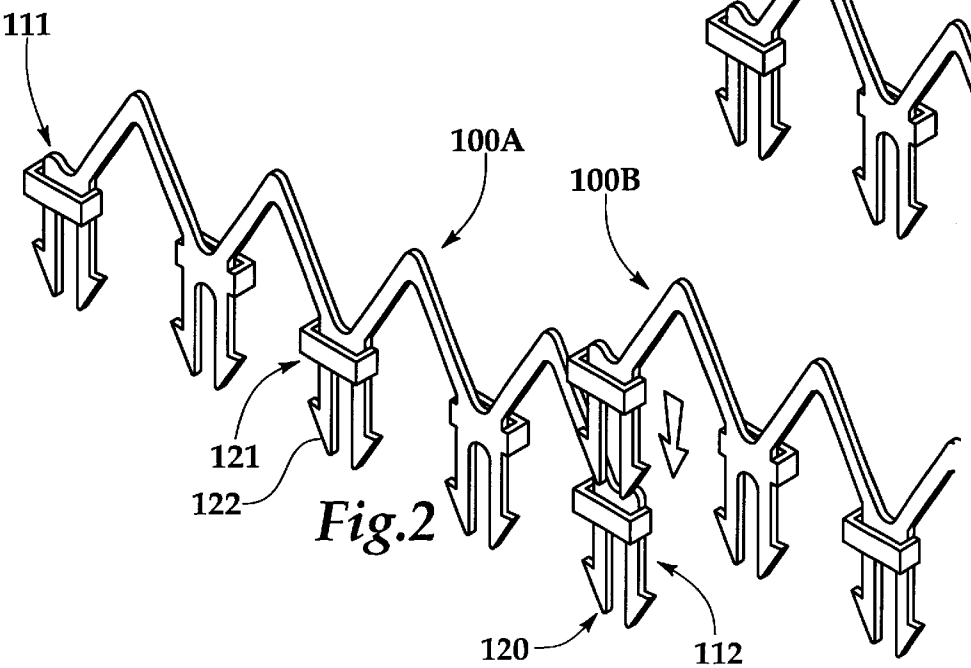
FIG. 2 illustrates an elevational view of two unjoined portions of the exemplary hair sculpting device illustrated in FIG. 1.

Turning now to FIG. 2, illustrated is an elevational view of two unjoined portions 100-A and 100-B of the exemplary hair sculpting device 100. As illustrated, the universal coupling means 120 can be provided at one or more locations along the middle portion 113 of the device 100. The universal coupling means 120 are adapted to allow the first and second free end portions 111 and 112 of a hair sculpting device 100, or an intermediate location thereof, to be selectively coupled to another location of the same or a different hair sculpting device. By providing the means for hair sculpting device 100 to be coupled to one or more additional devices, a user can configure the device(s) as a function of their individual hair length or desired hair style. In such embodiments, the end portions 111 and 112 can be selectively coupled to any intermediate location of the device having a coupling means. Furthermore, one or more intermediate locations of the hair sculpting device 100 can be selectively coupled to other intermediate locations of the same device, or to a second device. The exemplary hair sculpting device 100 is infinitely configurable and adaptable to a broad range of desired hairstyles. One or more such devices can be coupled into a desired configuration prior to insertion into a users hair, or the devices can be selectively coupled after insertion.

In the exemplary hair sculpting device 100, the universal coupling means 120 are integrally-formed with the elongate member 110. Such embodiments can be suitably manufactured using plastic materials, which may be either rigid or flexible. Furthermore, the use of plastic materials provides the easy capability to mold the device in a variety of colors, including the molding of various portions of the same device from different colors.

Figure 3:
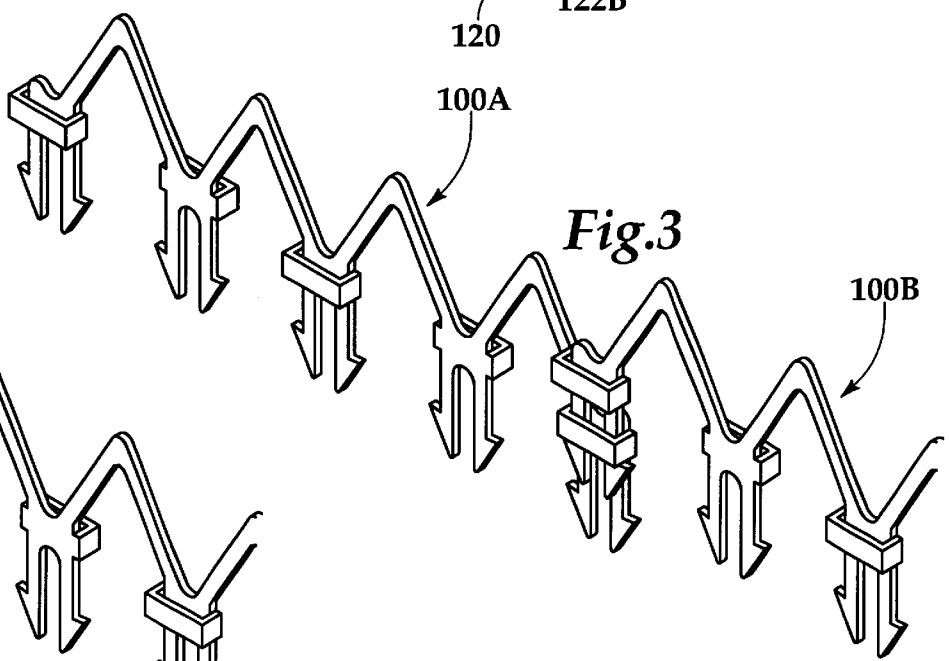
FIG. 3 illustrates an elevational view of two joined portions of the exemplary hair sculpting device illustrated in FIG. 1.

Referring now to FIG. 3, illustrated is an elevational view of two joined portions 100-A and 100-B of the exemplary hair sculpting device 100. As illustrated, a male portion 122 is inserted into and retained by female portion 121. The first and second flexible prongs 122-A and 122-B of male portion 122 are preferably flexible whereby they flex inwardly as pushed through female portion 121 in order to allow the outwardly projecting shoulder portions 123 to pass therethrough. After passing through female portion 121, the first and second flexible prongs 122-A and 122-B of male portion 122 return to a normal position wherein the shoulder portions 123 retain the male portion 122 in the female portion 121. As noted previously, the outwardly projecting shoulder portions 123 also provide a means to anchor the device within a user's hair.

Figures 4, 5:
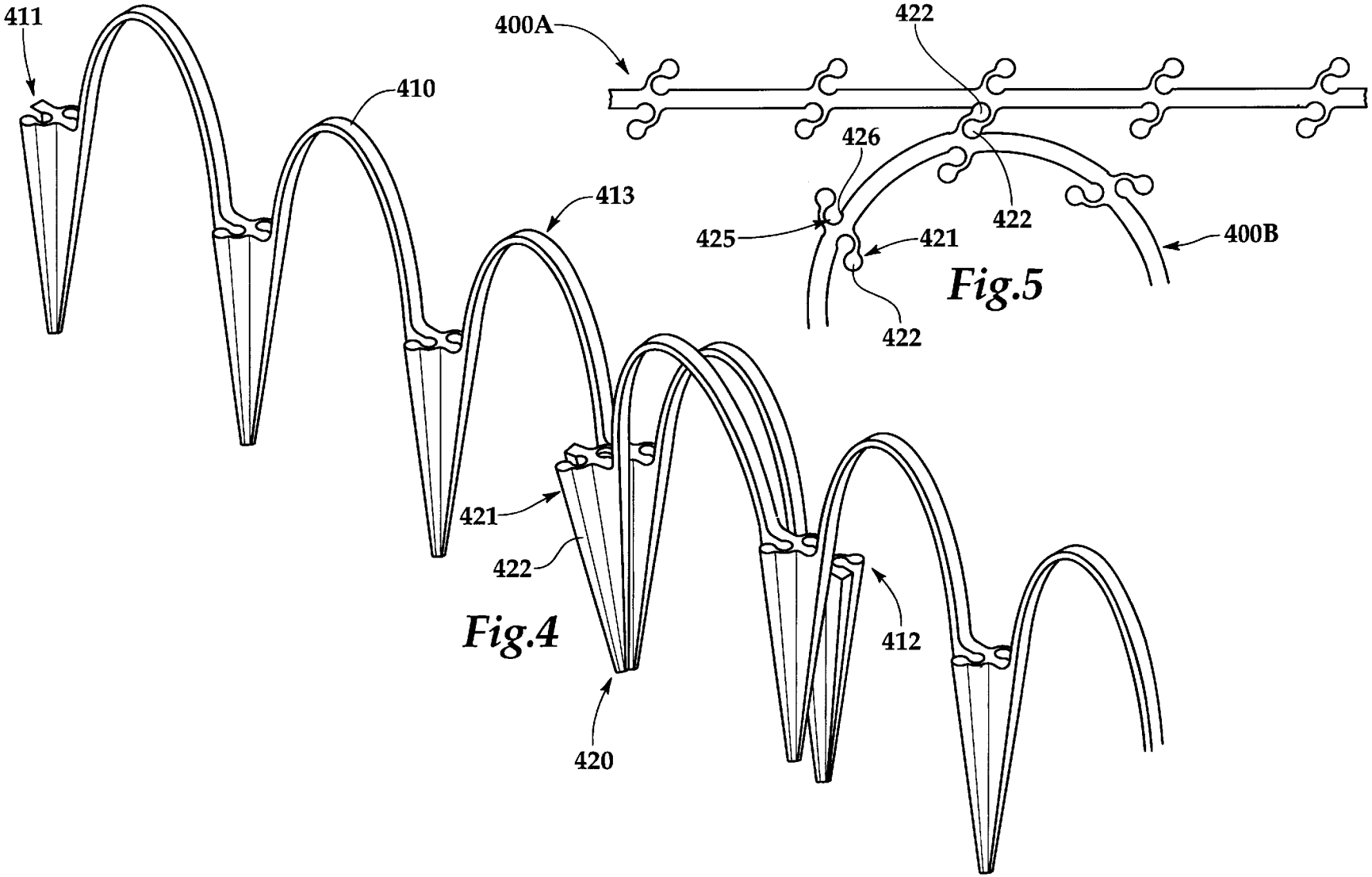
FIG. 4 illustrates an elevational view of a second exemplary hair sculpting device in accordance with the principles of the present invention.
FIG. 5 illustrates a top view of two joined portions of the exemplary hair sculpting device illustrated in FIG. 4.

Turning now to FIG. 4, illustrated is an elevational view of a second exemplary hair sculpting device 400 in accordance with the principles of the present invention. The exemplary hair sculpting device 400 is similar to device 100 in its principle features; each includes an elongated member having first and second free end portions and a middle portion, and universal coupling means are disposed proximate the first and second free end portions and at least one intermediate location along the middle portion of the elongated member.

The hair sculpting device 400 includes an elongated member 410 having first and second free end portions, generally designated 411 and 412, respectively, and a middle portion, generally designated 413. The elongated member 410 includes a plurality of arcuate portions forming interstitial regions in which locks of hair can be confined and retained. As noted previously, however, the elongated member 410 can take any desired form, such as straight or curved, or a combination of various forms.

The hair sculpting device 400 further includes universal coupling means, generally designated 420, disposed proximate the first and second free end portions 411 and 412. Universal coupling means 420 are also provided at intermediate locations along the middle portion 413 of the elongated member 410. The universal coupling means 420 include a male portion 421 having an external wall 422 and a female portion 425 having an internal wall 426 (see, also, FIG. 5). In the embodiment illustrated, the male portion 421 is essentially a tapered rod and the female portion 425 comprises a tapered channel having a profile substantially similar to that of the tapered rod; ie., the external wall of the male portion 421 has a profile substantially similar to the internal wall 426 of the female portion 425. In the specific embodiment illustrated, the male portion 421 and female portion 425 are adjacent and axially-aligned, wherein the female portion comprises a C-shaped member that couples the male portion 421 to the elongated member 413.

As noted previously with respect to exemplary hair sculpting device 100, coupling means can be provided at one or more desirable locations of the elongated member, in addition to the end portions 411 and 412. In such embodiments, the end portions of the hair sculpting device 400 can be selectively coupled to any intermediate location of the device having a coupling means 420.

Figure 6:
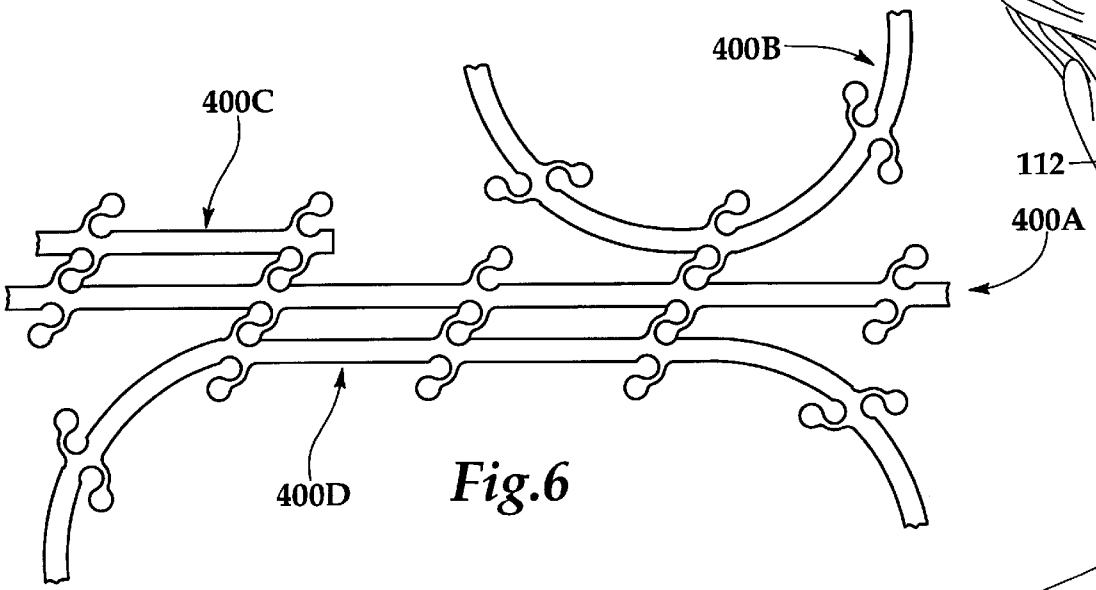
FIG. 6 illustrates a top view of four joined portions of the exemplary hair sculpting device illustrated in FIG. 4.

Referring to FIG. 5, illustrated is a top view of two joined portions 400-A and 400-B of the exemplary hair sculpting device 400. As illustrated therein, male portions 422 of two universal coupling means 420 can be slidably received and retained in the corresponding female portions of such coupling means, thereby interlocking the two portions 400-A and 400B. Furthermore, one or more intermediate locations of a hair sculpting device 400 can be selectively coupled to other intermediate locations of the same device, or to a second device. For example, FIG. 6 illustrates a top view of four joined portions 400-A, 400B, 400-C and 400-D of the exemplary hair sculpting device 400. Thus, it can be seen that one or more hair sculpting devices 400 are infinitely configurable and adaptable to a broad range of desired hairstyles.

Like the hair sculpting device 100 illustrated in FIGS. 1-3, the hair sculpting device 400 preferably includes universal coupling means 420 that are integrally-formed with the elongate member 413. Such embodiments can be suitably manufactured using plastic materials, which may be either rigid or flexible. Furthermore, the use of plastic materials provides the easy capability to mold the device in a variety of colors, including the molding of various portions of the same device from different colors.

Figure 7:
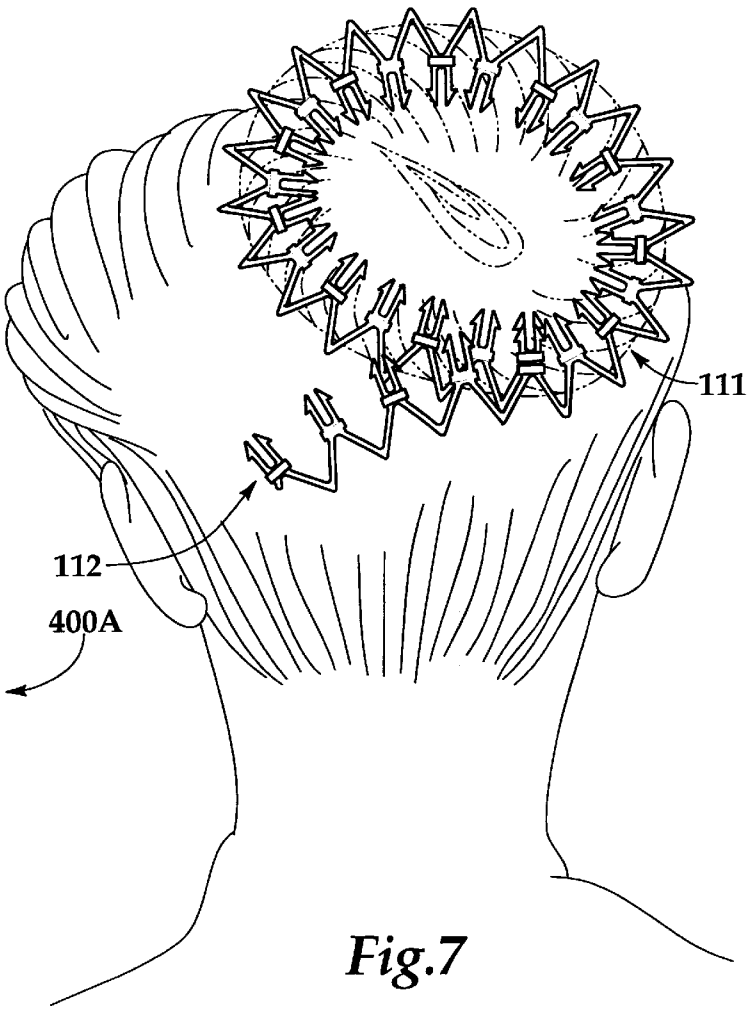
FIG. 7 illustrates the use of a device in accordance with the principles of the present invention for sculpting hair.

Is Finally, FIG. 7 illustrates the use of a hair sculpting device 100 in accordance with the principles of the present invention for sculpting hair. The universal coupling means, generally designated 120, are adapted to allow the first and second free end portions 111 and 112 of a hair sculpting device 100, or an intermediate location thereof, to be selectively coupled to another location of the same or a different hair sculpting device. In FIG. 7, free end portion 111 is shown coupled to an intermediate location of the device, while free end portion 112 remains uncoupled; free end portion 112 can be coupled to another intermediate location of the same device or, can be coupled to an additional device as a function of an individual's hair length or desired hair style.

Although the present invention has been described in detail, those skilled in the art will conceive of various changes, substitutions and alterations to the exemplary embodiments described herein without departing from the spirit and scope of the invention in its broadest form. The exemplary embodiments presented herein illustrate the principles of the invention and are not intended to be exhaustive or to limit the invention to the specific form disclosed; it is intended that the scope of the invention only be limited to the scope of the claims appended hereto.

What is claimed is:

1. A device for sculpting hair, said device comprising:

an elongated member having first and second free end portions and a middle portion; and universal coupling means disposed proximate said first and second free end portions and an intermediate location along said middle portion, said universal coupling means adapted to allow said first and second free end portions and said intermediate location to be selectively coupled, wherein said universal coupling means comprises a male portion and a female portion, said female portion operative to receive and retain said male portion, and wherein said female portion comprises a closed loop and said male portion comprises adjacent first and second flexible prongs, each of said prongs having an outwardly projecting shoulder portion, said outwardly projecting shoulder portion adapted to retain said male portion in said female portion.

2. The device recited in claim 1, wherein said elongated member comprises a plurality of serpentine portions forming interstitial regions in which locks of hair can be confined and retained.

3. The device recited in claim 2, wherein said serpentine portions are substantially arcuate.

4. The device recited in claim 1, wherein said universal coupling means are disposed at a plurality of locations along said middle portion.

5. A device for sculpting hair, said device comprising:

an elongated member having first and second free end portions and a middle portion; and universal coupling means disposed proximate said first and second free end portions and an intermediate location along said middle portion, said universal coupling means adapted to allow said first and second free end portions and said intermediate location to be selectively coupled, wherein said universal coupling means comprises a male portion having an external wall and a female portion having an internal wall, said external wall having a profile substantially similar to said internal wall, and wherein said male portion comprises a tapered cylinder and said female portion comprises a C-shaped member having an internal wall defining a tapered cylinder.

6. The device recited in claim 5, wherein said male and female portions are adjacent and axially-aligned.

7. The device recited in claim 1, wherein said elongated member is flexible.

8. The device recited in claim 7, wherein said elongated member is comprised of plastic.

9. The device recited in claim 8, wherein said universal coupling means are integrally-formed with said elongate member.

10. The device recited in claim 5, wherein said elongated member is flexible.

11. The device recited in claim 5, wherein said elongated member is comprised of plastic.

12. The device recited in claim 5, wherein said universal coupling means are integrally-formed with said elongate member.

* * * * *